US005616089A

United States Patent [19]

Miller

[11] Patent Number: 5,616,089

[45] Date of Patent: Apr. 1, 1997

[54] METHOD OF PUTTING

[76] Inventor: Dale D. Miller, 4801 Indigo Dr., Wausau, Wis. 54401

[21] Appl. No.: 624,264

[22] Filed: Mar. 29, 1996

[51] Int. Cl.[6] ..... A63B 53/00

[52] U.S. Cl. ..... 473/409; 473/131; 473/300

[58] Field of Search ..... 473/131, 409, 473/207, 212, 213, 214, 226, 251, 266, 293, 300, 294, 252

[56] References Cited

U.S. PATENT DOCUMENTS

| | | | |
|---|---|---|---|
| 3,263,998 | 8/1966 | Fanning | 473/409 |
| 3,486,755 | 12/1969 | Hodge | 473/293 |
| 4,067,573 | 1/1978 | Key, Jr. | 473/300 |
| 4,272,077 | 6/1981 | Spivey | 473/300 |
| 4,605,228 | 8/1986 | Guendling, Jr. | 473/293 |

*Primary Examiner*—Steven B. Wong
*Attorney, Agent, or Firm*—Andrus, Sceales, Starke & Sawall

[57] ABSTRACT

A method of putting features the golfer's dominant hand so that the golfer can improve control over putting speed and direction. The golfer's non-dominant hand stabilizes the dominant hand and the orientation of the putter blade, but does not otherwise substantially interfere with the putting stroke. In particular, a right-handed golfer grips the putter grip with their right hand in a conventional manner so that the thumb on the right hand is placed straight down the top surface of the putter grip. The golfer addresses the ball as if to stroke the putter using only the right hand. Then, the golfer takes the left hand and uses it to stabilize the right hand and the putter. To do this, the golfer places their left hand over the interior wrist portion of the right hand behind the thumb of the right hand with the middle finger of the left hand resting on the styloid process of the right hand. The golfer presses the ring finger and the little finger of their left hand against the back of the right hand. The golfer also presses the palm of the left hand against the putter grip and squeezes the right hand with the left hand. The golfer then takes a full putting stroke with the above described grip.

13 Claims, 2 Drawing Sheets

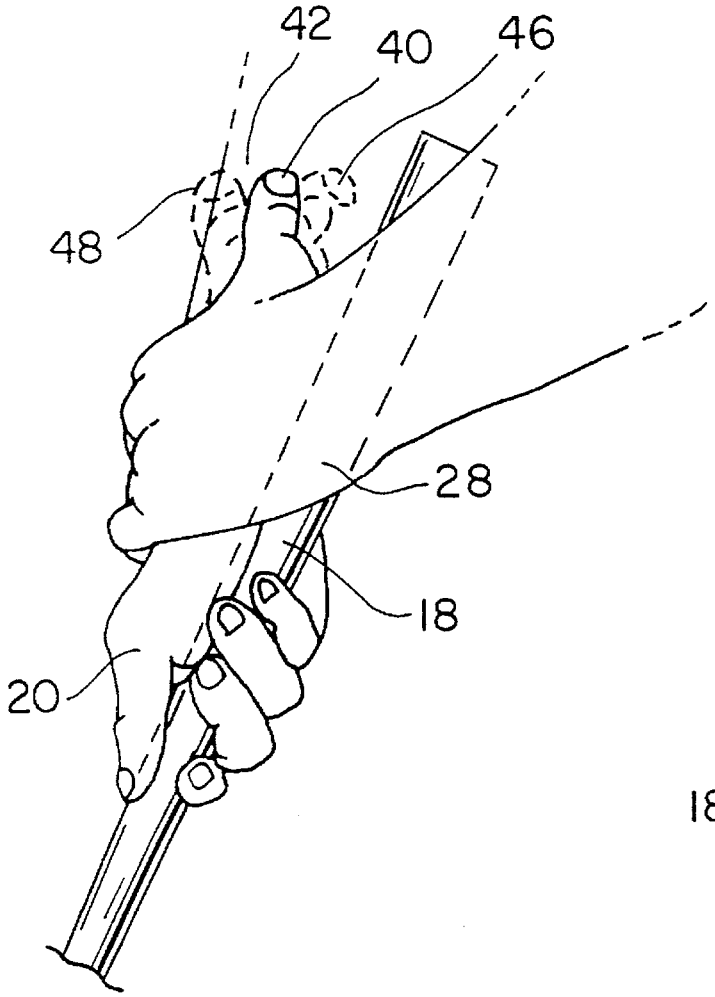
FIG. 4
FIG. 5
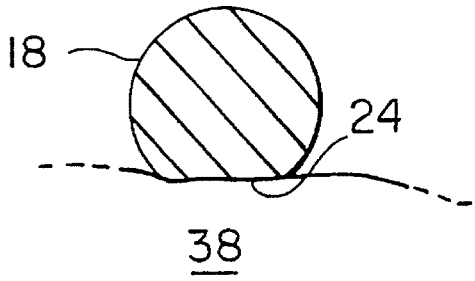

METHOD OF PUTTING

FIELD OF THE INVENTION

The invention relates to the game of golf, and in particular to a method of putting.

BACKGROUND OF THE INVENTION

Many golfers would like to improve their putting. When a golfer uses a conventional putting method, the golfer grips the putter with one hand above or below the other hand. The golfer then addresses the ball and strokes the ball towards the hole. Using a conventional grip, a golfer's non-dominant hand leads the putting stroke, and this can cause inconsistency, especially among intermediate or older golfers.

In order to improve the control that a golfer has over the speed of the putt and the direction of the putt, some golfers have found it desirable to use a putting stroke featuring the golfer's dominant throwing hand, thereby optimizing the coordination of the dominant hand.

Some golfers attempt putting one-handed with the dominant hand. However, it is difficult to stabilize the putter face with one hand, especially when the blade of the putter impacts the golf ball off-center.

SUMMARY OF THE INVENTION

The invention is a putting method in which the golfer controls the speed of the putt and the direction of the putt primarily with the golfer's dominant throwing hand, yet uses the golfer's non-dominant hand to maintain the blade of the putter stable.

In particular, the golfer grips the putter grip with the dominant hand in the conventional manner. The bottom of the thumb on the dominant hand should be placed straight down the top surface of the grip. Although the method can be used with any type of putter, it is preferred that the putter be somewhat longer than a conventional putter, e.g. the preferred putter should have a shaft length of 35 to 38 inches. It is also preferred that the top surface of the grip be flat. The dominant hand should grip the putter grip approximately 3 inches below the top end of the grip.

The golfer addresses the ball as if to stroke the putter using only the dominant hand. The golfer then takes the non-dominant hand and uses it to stabilize the dominant hand and the putter by:

a) placing the non-dominant hand over the interior wrist portion of the dominant hand behind the thumb of the dominant hand with the middle finger of the non-dominant hand resting on the styloid process (i.e. the wrist bone) of the dominant hand;

b) pressing the ring finger and the little finger of the non-dominant hand against the back of the dominant hand;

c) pressing the palm of the non-dominant hand against the flat top grip surface as the non-dominant hand squeezes the dominant hand.

The full putting stroke is made with the dominant hand and the non-dominant hands gripping the putter as described. With this putting grip, the golfer can control the speed and direction of the putt primarily with their dominant hand, and use the non-dominant hand to stabilize the putter face without interfering with the stroke.

When using this putting grip, it would be normal for the thumb of the non-dominant hand to be positioned in the middle of the forearm for the dominant hand pointing straight up the interior portion of the forearm. The thumb of the non-dominant hand can, however, be rotated on the forearm to adjust the direction of the putter blade. The golfer is thus allowed to fine tune the putting direction with precision. For instance, with a right-handed golfer, the tip of the thumb on the left hand can be moved clockwise with respect to the forearm of the right hand to move the putter blade to the right. Conversely, the tip of the thumb on the left hand can be moved counter-clockwise to move the putter blade to face to the left. If the golfer finds that the ball is rolling to the left or to the right of the hole on a consistent basis, the golfer only need move the thumb on their left hand to adjust.

As discussed above, the invention allows the golfer to control putting speed and direction by featuring the dominant hand in the putting stroke, and using the non-dominant hand to stabilize the orientation of the putter blade without interfering with the stroke. In addition, the method also requires that the golfer's shoulders be square while addressing the ball, therefore promoting parallel alignment which also leads to consistent putting.

BRIEF DESCRIPTION OF THE DRAWINGS

FIG. 4 is an elevational view from the back shoulder side of the golfer shown in FIG. 1 showing the putting grip in detail.

FIG. 5 is a view taken along line 5—5 in FIG. 2.

DETAILED DESCRIPTION OF THE PREFERRED EMBODIMENT OF THE INVENTION

Figure 1:
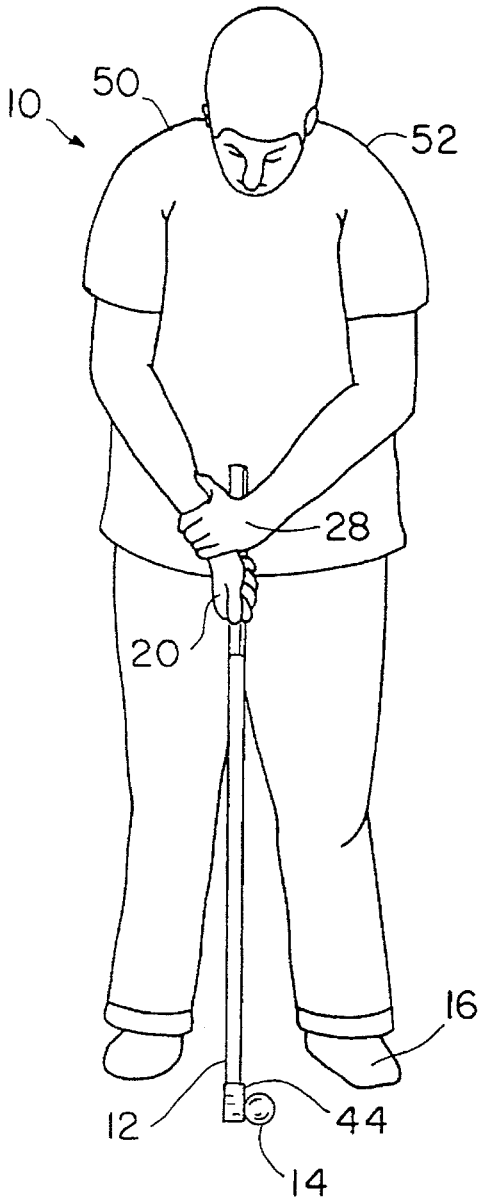
FIG. 1 is a schematic drawing illustrating a golfer using a putting grip in accordance with the invention.
Figure 2:
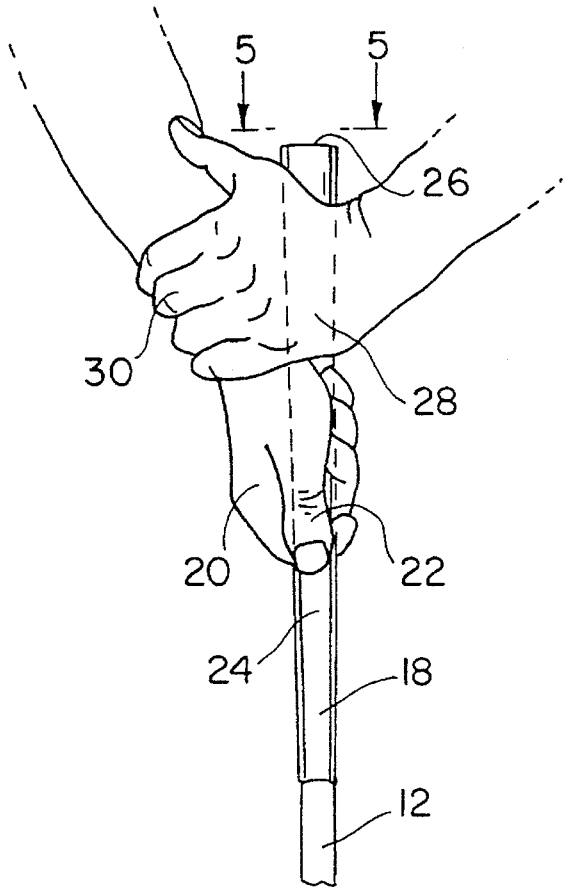
FIG. 2 is an elevational view from the front of the golfer shown in FIG. 1 showing the putting grip in detail.
Figure 3:
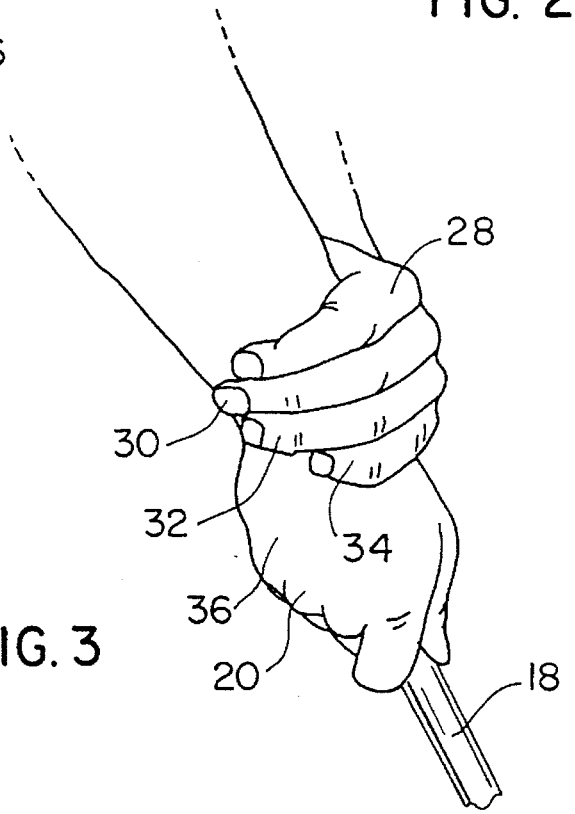
FIG. 3 is an elevational view from the front shoulder side of the golfer shown in FIG. 1 showing the putting grip in detail.

FIG. 1 shows a golfer 10 gripping a putter 12 and addressing a golf ball 14 in accordance with the invention. In FIG. 1, the golfer 10 is addressing a golf ball 14 located in the middle of the golfer's stance in preparation of putting the ball 14. In carrying out the invention, it is not necessary that the golfer 10 address the ball 14 in the middle of the golfer's stance, and many golfers may prefer to putt off the inside of the front foot 16. The golfer 10 in FIG. 1 is putting right handed. On the other hand, a golfer can carry out the invention left-handed by switching the orientation of the grip. For the purposes of this detailed description of the preferred embodiment of the invention, it should be assumed that the golfer's 10 right hand 20 is the golfer's dominant throwing hand.

Referring to FIGS. 2–5, the golfer 10 grips the putter grip 18 with the right hand 20 in the conventional manner. This means that the golfer 10 should grip the putter grip 18 with the right hand 20 so that the grip 18 extends through the palm and forefingers of the golfer's right hand 20 and the golfer's right hand thumb 22 points substantially downward along the grip 18 of the putter 12. It is preferred that the bottom of the thumb 22 on the golfer's right hand 20 should be placed straight down the top surface 24 of the grip 18.

It is preferred that the right hand 20 grip the putter grip 18 approximately 3 inches below the top end 26 of the grip 18. Although the method of putting can be used with many kinds of putters, it is preferred that the putter 12 have a shaft that is somewhat longer than a conventional putter. For example, the preferred putter 12 should have a shaft length of approximately 35 to 38 inches. It is also preferred that the putter grip 18 have a flat top surface 24 (see FIG. 5).

After the golfer 10 grips the putter grip 18 with the right hand 20, the golfer addresses the ball 14 as if to stroke the putter 12 using only the right hand 20. Then the golfer uses the left hand 28 to stabilize the right hand 20 and the putter 12. In particular, the golfer 10 places the left hand 28 over the interior wrist portion of the right hand 20 behind the thumb 22 of the right hand 20. In doing so, the golfer 10 rests the middle finger 30 of the left hand 28 on the styloid process (i.e. the wrist bone) of the right hand 20. The golfer presses the ring finger 32 and the little finger 34 on the left hand 28 against the back 36 of the right hand 20. The golfer 10 then presses the palm 38 of their left hand 28 against the flat top grip surface 24 and squeezes the right hand 20 with the left hand 28. A full putting stroke is then made featuring the right hand 20, and using the left hand 28 to stabilize the right hand 20 and the putter 12.

Referring now in particular to FIG. 4, it would be normal when using this inventive putting grip for the thumb 40 on the left hand 28 to be positioned in the middle of the forearm 42 for the right hand 20 pointing straight up the interior portion of the forearm 42. The thumb 40 on the left hand 28 can be rotated on the forearm 42, however, to adjust the direction of the putter blade 44, FIG. 1. The golfer 10 can thus fine tune the putting direction with precision in the event the golfer finds that the ball 14 is consistently rolling to the right or to the left of the hole. In particular, the golfer 10 can adjust the putter blade 44 to the left by moving the thumb 40 on the left hand 28 counter-clockwise with respect to the forearm 42, as indicated in phantom on FIG. 4 with reference number 46. Conversely, the tip of the thumb 40 on the left hand 28 can be moved clockwise to adjust the putter blade 44 to the right as is shown in phantom in FIG. 4 by reference numeral 48.

It should be appreciated that the above-described putting grip allows the golfer to control putting speed and direction with the golfer's dominant throwing hand, while at the same time uses the golfer's non-dominant hand to stabilize the orientation of the putter blade 44 without substantially interfering with the putting stroke. In addition, the putting method also requires that the golfer's shoulders 50 and 52, FIG. 1, be substantially square while the golfer 10 is addressing and stroking the ball 14. The squaring of shoulders 50 and 52 promotes parallel alignment which further leads to consistent putting.

While it is preferred that a right handed golfer grip the putter with their right hand 20 and use the left hand 28 to stabilize the right hand 20 and the putter 12, it is preferred that a left handed golfer would grip the putter 12 with their left hand and use the right hand to stabilize the left hand and the putter.

One of the advantages of the invention is to allow the golfer to control the putting speed and direction primarily with their dominant throwing hand. However, some golfers may choose to grip the putter 12 with their non-dominant throwing hand and use the dominant hand to stabilize the non-dominant hand and the putter.

It is recognized that various equivalents, alternatives and modifications are possible within the scope of the following claims.

I claim:

1. A method of gripping a putter comprising the steps:

gripping a putter grip with a dominant hand;

placing a non-dominant hand over an interior wrist portion of the dominant hand behind a thumb of the dominant hand;

resting a middle finger of the non-dominant hand on the styloid process of the dominant hand;

pressing a ring finger and a little finger of the non-dominant hand against the back of the dominant hand;

pressing the palm of the non-dominant hand against a forward surface of the putter grip as the non-dominant hand squeezes the dominant hand.

2. A method of gripping a putter as recited in claim 1 further comprising the steps of:

placing a thumb on the non-dominant hand on a forearm of the dominant hand; and adjusting the orientation of a putter blade by moving the thumb on the non-dominant hand clockwise or counter-clockwise with respect to the forearm of the dominant hand.

3. A method as recited in claim 1 wherein the putter grip has a front surface that is flat, and the palm of the non-dominant hand presses against the flat forward surface of the putter grip.

4. A method of gripping a putter as recited in claim 1 wherein the dominant hand is positioned between two to four inches below a top end of the putter grip.

5. A method of putting comprising the steps of:

gripping a putter having a shaft length of at least 32 inches by gripping a grip of the putter with a dominant hand;

placing a non-dominant hand over an interior wrist portion of the dominant hand behind a thumb of the dominant hand;

resting a middle finger on the non-dominant hand on the styloid process of the dominant hand;

pressing a ring finger and a little finger of the non-dominant hand against the back of the dominant hand;

pressing the palm of the non-dominant hand against a forward surface of the putter grip as the non-dominant hand squeezes the dominant hand; and stroking the putter to impact a golf ball with a blade of the putter.

6. A method of gripping a putter comprising the steps:

gripping a putter grip with a right hand;

placing a left hand over an interior wrist portion of the right hand behind a thumb of the right hand;

resting a middle finger of the left hand on the styloid process of the right hand;

pressing a ring finger and a little finger of the left hand against the back of the right hand;

pressing the palm of the left hand against a forward surface of the putter grip as the left hand squeezes the right hand.

7. A method of gripping a putter as recited in claim 6 further comprising the steps of:

placing a thumb on the left hand on a forearm of the right hand; and adjusting the orientation of a putter blade by moving the thumb on the left hand clockwise or counter-clockwise with respect to the forearm of the right hand.

8. A method as recited in claim 6 wherein the putter grip has a front surface that is flat, and the palm of the left hand presses against the flat forward surface of the putter grip.

9. A method of gripping a putter as recited in claim 6 wherein the right hand is positioned between two to four inches below a top end of the putter grip.

10. A method of gripping a putter comprising the steps:

gripping a putter grip with a left hand;

placing a right hand over an interior wrist portion of the left hand behind a thumb of the left hand;

resting a middle finger of the right hand on the styloid process of the left hand;

pressing a ring finger and a little finger of the right hand against the back of the left hand;

pressing the palm of the right hand against a forward surface of the putter grip as the right hand squeezes the left hand.

11. A method of gripping a putter as recited in claim 10 further comprising the steps of:

placing a thumb on the right hand on a forearm of the left hand; and adjusting the orientation of a putter blade by moving the thumb on the right hand clockwise or counter-clockwise with respect to the forearm of the left hand.

12. A method as recited in claim 10 wherein the putter grip has a front surface that is flat, and the palm of the right hand presses against the flat forward surface of the putter grip.

13. A method of gripping a purer as recited in claim 10 wherein the left hand is positioned between two to four inches below a top end of the putter grip.

* * * * *